US010112742B1

(12) United States Patent
Circosta

(10) Patent No.: US 10,112,742 B1
(45) Date of Patent: Oct. 30, 2018

(54) BOTTLE CAP

(71) Applicant: Can't Live Without It, LLC, New York, NY (US)

(72) Inventor: Michael Circosta, Brooklyn, NY (US)

(73) Assignee: CAN'T LIVE WITHOUT IT, LLC, New York, NY (US)

( * ) Notice: Subject to any disclaimer, the term of this patent is extended or adjusted under 35 U.S.C. 154(b) by 0 days.

(21) Appl. No.: 15/679,742

(22) Filed: Aug. 17, 2017

(51) Int. Cl.
*B65D 41/04* (2006.01)
*B65D 1/02* (2006.01)

(52) U.S. Cl.
CPC ..... *B65D 41/0414* (2013.01); *B65D 1/0246* (2013.01)

(58) Field of Classification Search
CPC .. B65D 1/0246; B65D 41/0414; B65D 41/28; B65D 41/30
USPC ..... 215/354, 334
See application file for complete search history.

(56) References Cited

U.S. PATENT DOCUMENTS 2,723,040 A * 11/1955 Merolle ..... B65D 41/28 215/334
3,559,834 A * 2/1971 Taylor ..... B65D 39/00 215/261
4,369,643 A * 1/1983 Cianciolo ..... B23P 9/04 29/90.01
2003/0196985 A1* 10/2003 Wheeler ..... B65D 39/0052 215/277

* cited by examiner

*Primary Examiner* — Jeffrey Allen
(74) *Attorney, Agent, or Firm* — Kilpatrick Townsend & Stockton LLP

(57) ABSTRACT

A bottle cap having an outer skin secured to an inner core by means of an inwardly folded or rolled edge of the outer skin, and space provided in the inner core. The outer skin may be painted. The space may be provided by a rabbet.

22 Claims, 5 Drawing Sheets

BOTTLE CAP

The present disclosure generally relates to caps for containers. More specifically, the disclosure relates to container caps with an outer skin secured to an inner core, and structures and methods for effecting same.

BACKGROUND

In FIGS. 1A-1C and, 2A-2C, there are illustrated in cross section two prior container caps in which an outer skin is secured to an inner core. In FIGS. 1A-1C, there is illustrated a bottle cap 100 with an unpainted, brushed, stainless steel skin secured to an inner plastic core. In FIGS. 2A-2C there is illustrated a bottle cap 200 with a painted stainless steel skin secured onto an inner plastic core.

In the bottle cap 100 of FIGS. 1A and 1B, an outer skin 102 of stainless steel is secured to an inner core 104 made of plastic, typically polypropylene. The inner core includes an inner cylindrical plug portion 106 concentrically surrounded by an outer tubular flange portion 108 that serves as a nut portion. An interior surface of the outer flange portion 108 is spaced from an exterior surface of the plug portion 106 and includes a molded threading 110 for mating engagement with a threading on a container neck (not illustrated). The outer flange portion 108 extends downwardly from a bight 112 at a top end of the inner cylindrical portion 106 to an edge portion 114. The edge portion 114 includes an edge face 116 facing away from the bight 112.

The outer skin 102 includes a top dome-shaped portion 120 with elongate dimples or depressions 122 and a downwardly extending tubular skirt portion 124. The outer skin defines an interior cavity with a cylindrical space 126 within the downwardly extending skirt portion 124 and a dome shaped space 128 within the dome-shaped portion 120.

During assembly, the inner core 104 is relatively inserted into the interior cavity defined by the outer skin 102 until the bight 112 bottoms out on an inner surface 130 of the dome shaped portion 120. Then, an edge portion or lip 132 of the outer skin 102 is partially rolled inwardly over the edge face 116 of the edge portion 114 into an L-shape in cross section to secure the outer skin 102 relative to the inner core 104.

One disadvantage of such an assembly is that painting of the outer skin 102 is not practical. First, the step of inwardly rolling the edge portion 132 of a pre-painted skin damages the paint by scratching it or otherwise causing it to crack. Second, post-assembly painting of the skin generally is not viable because the suitable paints require curing by baking at temperatures that exceed the melt temperature of the polypropylene plastic of the inner core 104.

In the bottle cap 200 of FIGS. 2A and 2B, an outer skin 202 of painted stainless steel also is secured to an inner core 204 also made of plastic, typically polypropylene. The inner core 204 similarly includes an inner cylindrical plug portion 206 concentrically surrounded by an outer tubular flange portion 208 that serves as a nut portion. An interior surface of the outer flange portion 208 is spaced from an exterior surface of the plug portion 206 and includes a molded threading for mating engagement with a threading on a container neck (not illustrated). The outer flange portion 208 extends downwardly from a bight 212 at a top end of the inner cylindrical portion 206 to an edge portion 214. The edge portion 214 includes an edge face 216 facing away from the bight 212.

Like the cap 100, the outer skin 202 of the cap 200 includes a top dome-shaped portion 220 with elongate dimples or depressions 222 and a downwardly extending tubular skirt portion 224. The outer skin defines an interior cavity with a cylindrical space 226 within the downwardly extending tubular skirt portion 224 and a dome shaped spaced 228 within the dome-shaped portion 220.

Unlike the stainless steel skin 102, the stainless steel skin 202 is painted and cured before assembly. Thus, there is no need to subject the skin to curing temperatures above the melting temperature of the polypropylene inner core 104 after assembly.

Also unlike the cap 100, to avoid the need to roll a bottom edge of the outer skin cylindrical skirt to secure the outer skin 202 to the inner core 204, the outer flange portion 208 of the inner core 204 includes an exterior circumferential concavity 240 positioned approximately midway between the bight 212 and the edge face 216. The circumferential concavity 240 provides a snap groove. The outer flange portion 208 also includes a bezel or ledge 242 that extends radially outward from the edge portion 214.

As can be seen, outer skin cylindrical skirt 224 includes an interior circumferential convexity 250 that matingly engages the circumferential concavity/snap groove 240. The convexity 250 is positioned approximately midway along the skirt 224. Due to the way in which the convexity is created, a circumferential concavity is formed about an exterior of the skirt 224.

During assembly of the cap 200, inner core 204 is relatively inserted into the interior cavity 226 defined by the outer skin 202 until the inner circumferential convexity 250 engages into the outer circumferential concavity 240 and snaps into place to secure the outer skin 202 to the inner core 204. At the same time, a bottom edge face or rim 252 of the outer skin tubular skirt 224 rests against the ledge 242 to hide the bottom edge face or rim 252, and avoid hazards from contact with a sharp edge that results from a trimming process.

Further, to assure engagement of the inner circumferential convexity 240 and the outer circumferential concavity 250, the outer skin tubular skirt 224 has a height dimension as measured from the ledge 242 that is longer than that of the flange 218, i.e., a longer dimension along a longitudinal axis of the cap 202. As a result, the point where the top dome-shaped portion 220 and the skirt 224 join is higher than the bight 212. Therefore, the bight 212 does not engage against the inner surface 230 of the dome portion, leaving excess interior space. This excess space increases the height of such caps and causes the caps to appear taller than the non-painted, brushed stainless steel caps.

SUMMARY

Disclosed herein are one or more inventions relating to container caps, and preferably, liquid container caps, and, more preferably, bottle caps. In particular, the one or more inventions relate to methods and structures for assembling together an outer skin onto an inner core such that the two are secured together after assembly.

The present disclosure provides a cap, e.g., a bottle cap, that enables a painted steel skin secured onto an inner plastic core, but without the need for the mating circumferential concavity and circumferential convexity or a bezel on the inner plastic core.

In an embodiment, a container cap comprises:

an inner core with an exterior first circumference T4 at a bottom edge and an exterior second circumference T3 at other than the bottom edge, and an outer skin secured on the inner core, the outer skin having a tubular skirt, the tubular skirt having a rolled edge at a bottom edge portion, the tubular skirt having an interior third circumference T1 where the rolled edge is not present and an interior fourth circumference T2 where the rolled edge is present, wherein, T4<T3, T2<T1, and T2<T3.

In an embodiment, T1<T3.

In an embodiment, the inner core has circumferential rabbet; and the rolled edge is located within a space defined by the rabbet.

In an embodiment, the inner core is made of plastic and the outer skin is made of stainless steel.

In an embodiment, the outer skin is painted.

In an embodiment, the outer skin includes a top portion closing off a top end of the tubular skirt.

In an embodiment, the inner core includes a tubular flange with a circumferential rabbet at a bottom end of an exterior surface of the flange.

In an embodiment, the inner core includes a tubular flange surrounding an inner plug portion, the flange having a circumferential rabbet at a bottom end of an exterior surface of the flange.

In an embodiment, a member comprises a hollow tubular skirt closed at one end by a top portion, the skirt having a bottom end that is folded inwardly with a rolled edge portion that is folded against an interior surface of the skirt.

In an embodiment, the member is made of stainless steel.

In an embodiment, an exterior surface of the member is painted.

In an embodiment, the top portion is dome-shaped.

In an embodiment, a liquid containment vessel has a neck with an opening and a container cap, the container cap comprising: (a) an inner core with an exterior first circumference T4 at a bottom edge and an exterior second circumference T3 at other than the bottom edge, and (b) an outer skin secured on the inner core, the outer skin having a tubular skirt, the tubular skirt having a rolled edge at a bottom edge portion, the tubular skirt having an interior third circumference T1 where the rolled edge is not present and an interior fourth circumference T2 where the rolled edge is present, wherein, T4<T3, T2<T1, and T2<T3.

In an embodiment, the vessel is a bottle.

In an embodiment, the bottle is a double-walled stainless bottle, with a vacuum between the walls.

BRIEF DESCRIPTION OF THE DRAWINGS

Illustrative embodiments of the present invention are described in detail below with reference to the attached drawing figures, which are incorporated by reference herein and wherein.

DETAILED DISCLOSURE

Figures 3A, 3B, 3C:
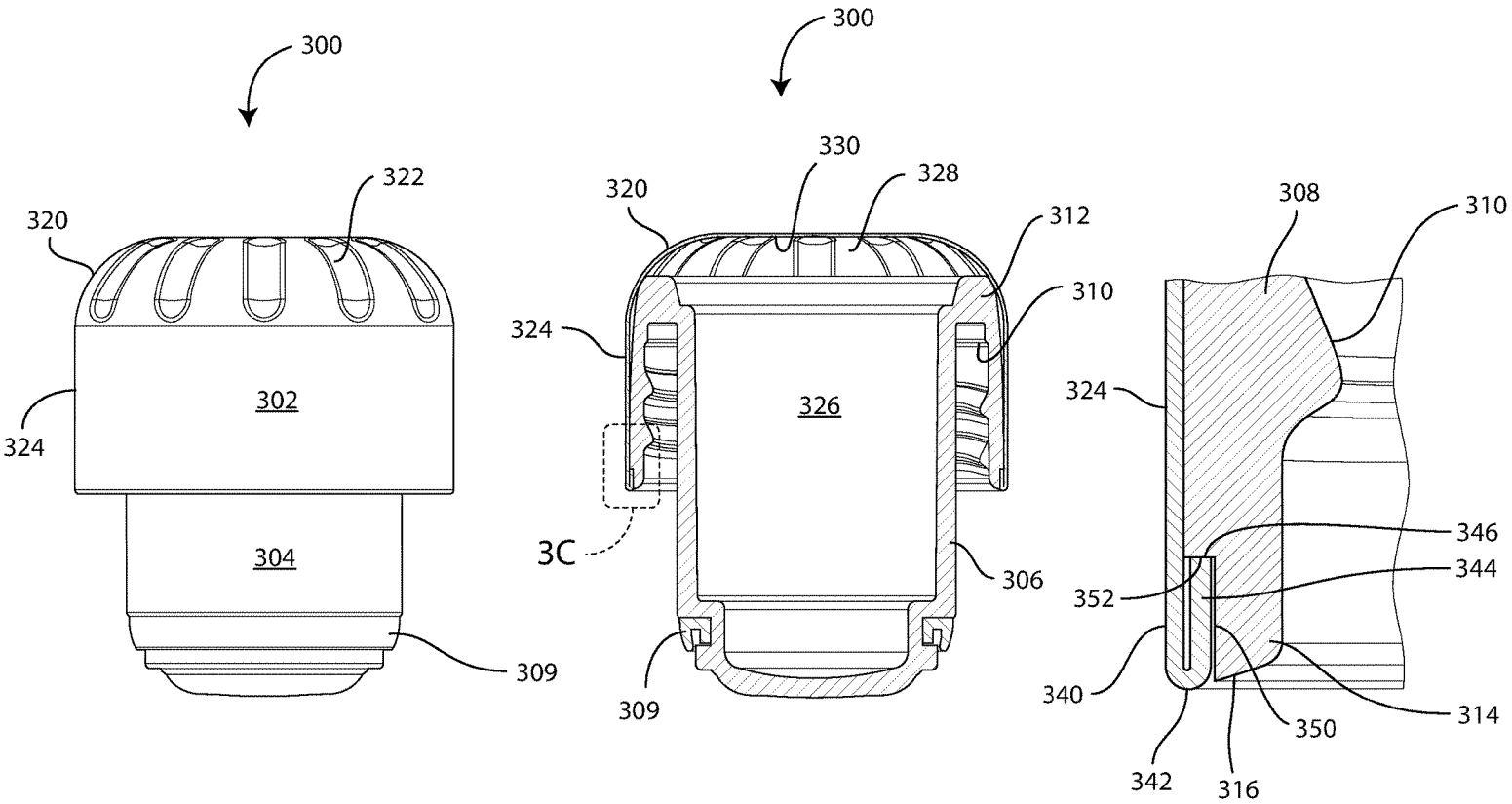
FIGS. 3A-3C illustrate a cap embodying principles disclosed herein with a painted or colored skin secured about an inner core.

In FIG. 3A-3C there is illustrated a bottle cap 300 embodying principles disclosed herein. In the bottle cap 300, an outer skin 302 of stainless steel is secured to an inner core 304 made of molded plastic, typically polypropylene, although any suitable material can be used. The inner core 304 includes an inner plug portion 306 concentrically surrounded by an outer tubular flange portion 308 that serves as a nut portion. Preferably, the inner plug portion 306 comprises a hollow cylinder or tubular member, thereby eliminating unnecessary material in the interior thereof. The plug portion 306 is used to seal an opening of a container by plugging the opening, and includes a gasket or o-ring 309 for that purpose. The outer skin 302 can also be viewed as a shell as, preferably, it is rigid.

An interior surface of the outer flange portion 308 is spaced from an exterior surface of the inner plug portion and includes a molded threading 310 for mating engagement with a threading on a container neck. The outer flange portion 308 extends downwardly from a bight 312 at a top end of the inner plug portion 306 to an edge portion 314. The edge portion 314 includes an edge face 316 facing away from the bight 312.

It can be appreciated that threading engagement is just one, preferable, way of securing the cap 300 to a container. Any suitable fastening arrangement can be used. Twist and lock, quick release, and friction fit are just some other examples of suitable arrangements.

The outer skin 302 includes a top dome-shaped portion 320 with elongate dimples or depressions 322 and a downwardly extending tubular skirt portion 324. The outer skin defines an interior cavity with a cylindrical space 326 within the downwardly extending skirt portion 324 and a dome shaped space 328 within the top dome-shaped portion 320.

To prevent spinning of the outer skin 302 relative to the inner core 304, a friction fit is provided between the inner core 304 and the outer skin 302. In this particular embodiment, this is accomplished by providing the tubular flange 308 with an outer circumference or diameter than is larger than an inner circumference or diameter of the tubular skirt 324. This forced fit not only prevents rotation of the outer skin 302 relative to the inner core 304, but also hinders relative axial movement between the two and helps conform the flange 308 to the outer skin 302, or at least to the skirt 324, to prevent flange 308 from flexing, dimpling, or otherwise deforming in relation to the outer skin 302.

Unlike the bottle cap 202, the outer skin tubular skirt 324 does not include an inner circumferential convexity approximately midway along the skirt, nor does the outer flange portion 308 include an outer circumferential concavity approximately midway along the flange portion. Rather, the outer skin tubular skirt includes generally straight and smooth exterior and interior surfaces.

However, the outer skin tubular skirt 324 preferably includes a rolled bottom edge portion 340 that is rolled or folded prior to painting of the outer skin 302. As a result of the roll or fold, the bottom end of the skirt 324 includes a turn, bight, or fold 342 and an upwardly extending end 344 with an edge or rim 346 that faces upward. As can be seen, the upwardly extending end 344 preferably is adjacent or nearly adjacent an interior surface of the skirt 324. The result is a tenon of sorts. For the sake of ease of understanding, this tenon is referred to herein as a rolled edge, which in this embodiment is the rolled edge 344.

Figure 4:
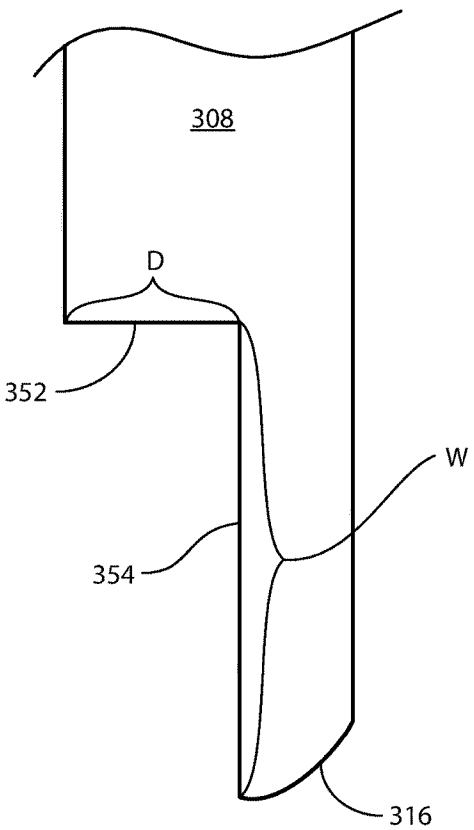
FIG. 4 illustrates a detail of a flange of an inner core of the cap of FIGS. 3A-3C.

The inner core flange 308 includes a circumferentially extending exterior rabbet 350 at its edge portion 314 that mates with the rolled edge 344. As illustrated in FIG. 4, the rabbet 350 includes a shoulder 352 and a cheek 354, which preferably are at right angles to each other. The shoulder 352 spans a depth D of the rabbet 350 while the cheek 354 spans a width W of the rabbet. The shoulder 352 serves as a downwardly facing surface against which the edge 346 of the rolled edge 344 can engage.

Referring again to FIGS. 3A-3C, the rabbet 350 and the edge portion 340 with the rolled edge 344 provide a snap function whereby the outer skin 302 is held secured to the inner core 304 after assembly because the rolled edge 344 prevents removal of the outer skin 302 via upward movement due to engagement of upwardly facing edge 346 of the rolled edge 344 against the shoulder/downwardly facing surface 352 of the rabbet 350. At the same time, the tight tolerance between the inner circumference of the skirt 324 and the outer circumference of the flange 308 prevents the rolled edge 344 from disengaging from the rabbet 350.

Further, due to the rollover of the rolled edge, i.e., a turn 354 in the edge 350, the sharp trimmed edge 352 is located within the outer skin tubular skirt 324 and between the outer skin tubular skirt 324 and the inner core flange 308 so that only the smooth turn 354 is exposed.

As such, this structure can be characterized as an outer skin with a rolled edge portion having an end portion that is inwardly folded with the end portion folded against the interior surface of the outer skin.

Yet further, because there is no need to accommodate a mating snapping function between in inwardly facing circumferential convexity and an outwardly facing circumferential concavity, bight 312 can be allowed to bottom out or otherwise engage against the interior surface of the dome portion 320. This enables the overall cap 300 to be shorter as extra height of the skirt 324 is not needed to ensure engagement of a convexity and a concavity. Thus, a cap with an overall look, an overall shape, and overall dimensions similar to those of the bottle cap 100 can be achieved. Yet the cap outer skin can be painted.

Figure 5:
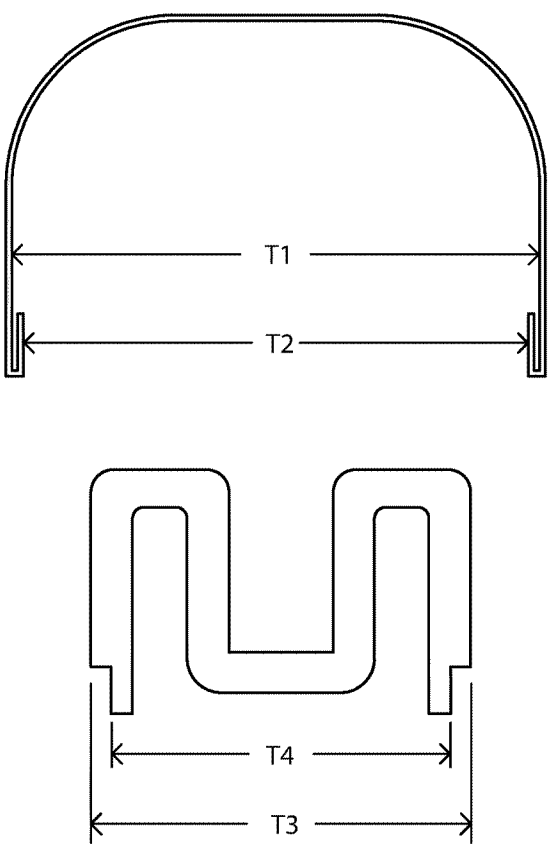
FIG. 5 illustrates general dimensional relationships between an outer skin and an inner core in accordance with principles disclosed herein.

As might be appreciated, in more general terms, and as illustrated in FIG. 5, the skirt 324 can be thought of as having two different dimensions, a larger interior diameter T1 that spans the skirt 324 where the rolled edge 344 is not present, and a smaller interior diameter T2 that spans the skirt 324 where the rolled edge 344 is present. These dimensions can also be considered interior circumferences. One difference between this embodiment and the prior concavity/convexity structure discussed above, is that the edge of the skirt 324 is hidden due to the folding of the rolled edge. Another difference is the lack of the concavity/convexity structure approximately midway along the skirt 224.

Similarly, the flange can be thought of as having two different dimensions at its lower edge portion 314. These dimensions are a larger outside diameter T3 wherein the shoulder 352 is not present, and a smaller outside diameter T4 wherein the shoulder is present. Alternatively, the dimensions could be exterior circumferences.

Hence, in more general terms, the relationship between the inner core and the outer skin can be expressed in terms of the interaction of the various different dimensions T1-T4 mentioned above. In this relationship, the dimension T1 is greater than the dimension T4, and the dimension T2 is less than the dimension T3. Further, T4 is less than T2. In this way, the relationship between T2 and T3 prevents the axial movement of the outer skin relative to the inner core, while the relationship between T3 and T4 allows the rolled edge to be hidden from view and touch. Further, taking into account the friction fit between the inner core and the outer skin described above, it can be expressed that T3 is greater than T1.

Essentially, with these relationships, it is not necessary to have a square rabbet as described. Instead, the outer bottom edge of the flange could simply taper inwardly proceeding axially toward the bottom. Alternatively, the shoulder of the rabbet could have a curved surface rather than a flat surface.

It should also be appreciated that while it has been discussed that the edge 346 of the rolled edge 344 engages against the shoulder of the rabbet, it is not necessary that it do so all of the time. The goal is to prevent axial removal of the outer skin relative to the inner core, however, it some initial states that might be a slight separation between the edge of the rolled edge and a surface that it might engage upon axial movement between the outer skin and the inner core.

Additionally, it can be appreciated that, given a thickness X of the outer skirt, in practice, a thickness of the skirt and the rolled edge will be 3X or less, as it may be difficult to achieve a completely flat fold with the rolled edge completely adjacent the interior surface of the skirt. Given sheet metal thickness of 0.4 mm, this may result in a 3X or less measurement of 1.2 mm.

Figures 1A, 1B, 1C:
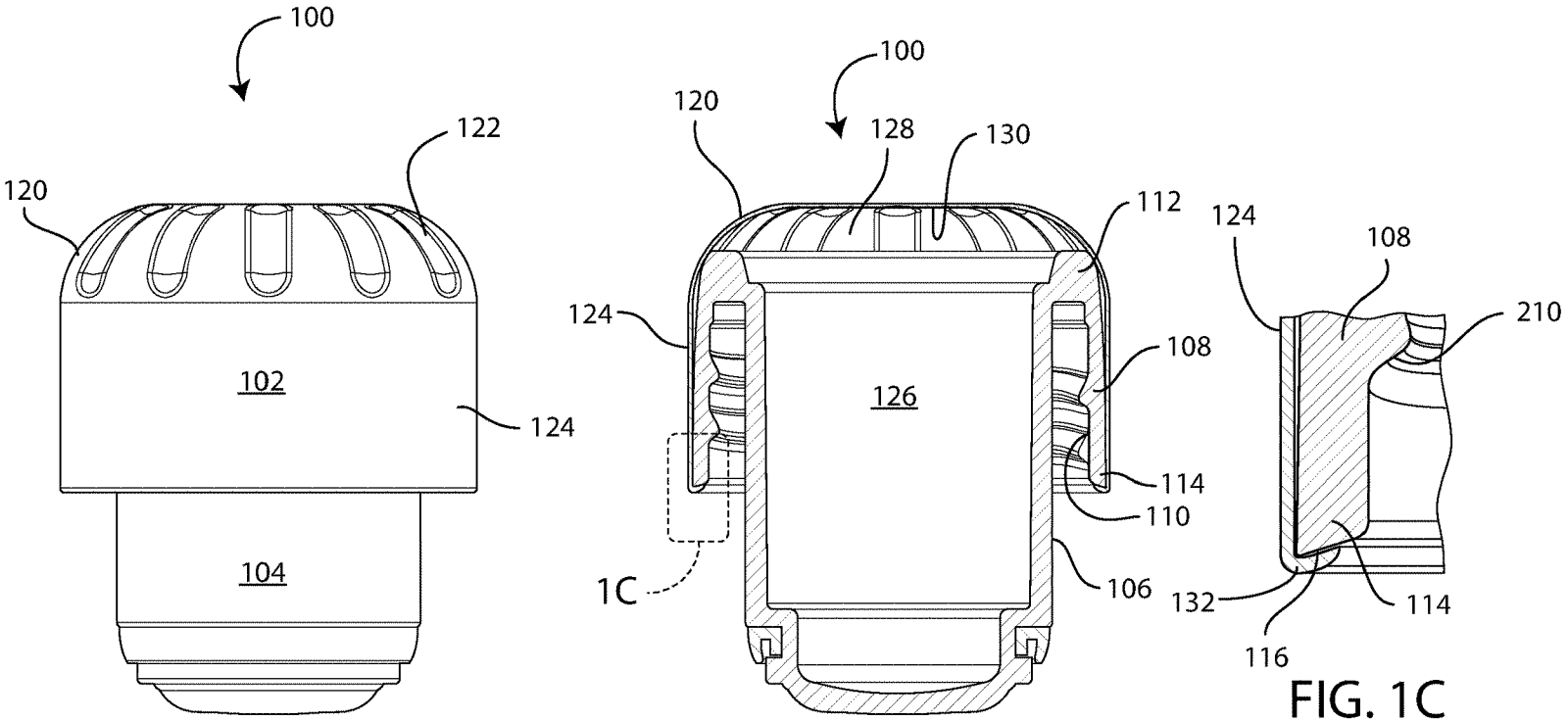
FIG. 1A PRIOR ART
FIG. 1B PRIOR ART
FIG. 1C PRIOR ART
FIGS. 1A-1C illustrate a prior cap with a brushed stainless steel skin secured about an inner core.
Figures 2A, 2B, 2C:
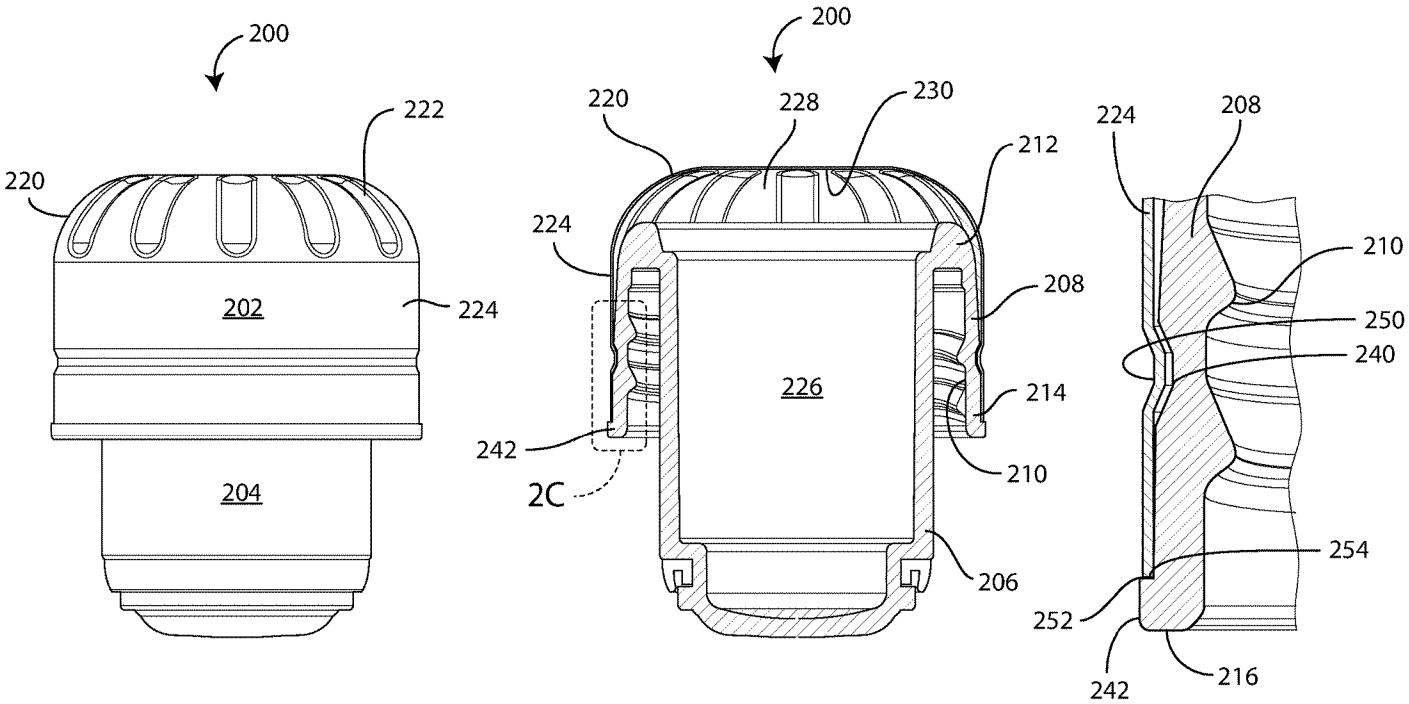
FIG. 2A PRIOR ART
FIG. 2B PRIOR ART
FIG. 2C PRIOR ART
FIGS. 2A-2C illustrate a prior cap with a painted stainless steel skin secured about an inner core.

In contrast, in the prior design described in connection with FIGS. 1A to 1C, the resulting L-shaped roll generally produces an edge dimension of 1.5 mm to 2.0 mm, or about 4X or greater. This dimension translates into overlap between that outer circumference/diameter of the flange and the smallest diameter of the skirt, that prevents insertion of the inner core into the interior space of the outer skin.

It can be appreciated that while the foregoing description has been made in connection with a screw-on bottle cap, the same principles can be applied to a bottle stopper without a tubular flange. Stoppers typical include a plug portion that fit within an opening of a neck of a container and a top portion that sits outside of the opening, but which allows for manual removal of the stopper. The top portion can include an exterior circumferential rabbet at a bottom edge thereof, and an outer skin with a rolled edge can be secured thereto as described herein. The plug and/or the top portion can be hollow or solid. The top portion can be of any suitable shape in cross section such as round or polygonal.

Similarly, while the flange portion 308 has been shown as circular in cross section, other shapes are possible, such as polygonal shapes.

The outer skin 302 has been described as made of stainless steel, however other suitable materials include plastics and other metals. Moreover, while the outer skin is preferably painted, if materials other than stainless steel are used, the outer skin can be colored, e.g., via tinting or dyes.

Figure 6:
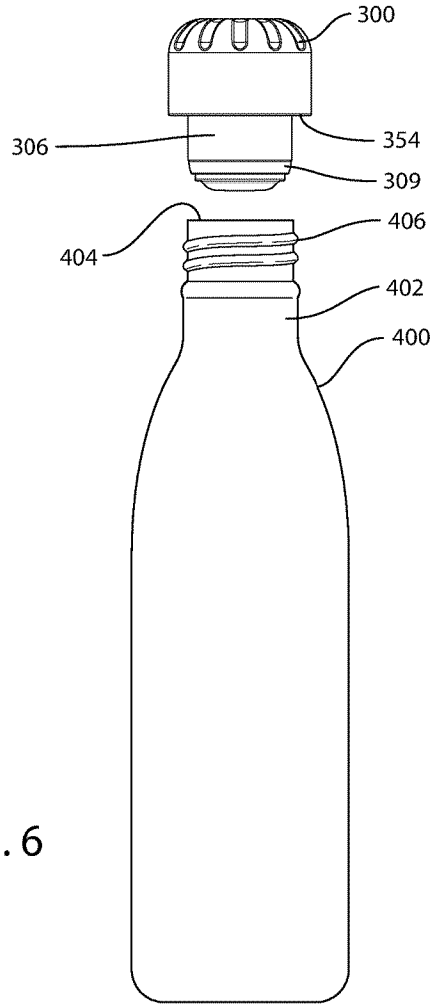
FIG. 6 illustrates an assembly including a container and a cap embodying principles disclosed herein.

In FIG. 6 there is shown an assembly of a container or vessel 400 and a cap 300 embodying principles of the invention. In this embodiment, the container or vessel 400 is a bottle with a neck 402 with a top end 404 including threading 406. The cap 300 is threadingly received on the neck 402 in the known manner. The plug portion 306 plugs an opening in the neck 402 in the known manner. The flange 308 and skirt 324 shroud an upper portion of the neck 402 as the top portion 404 is received within a gap between the exterior of the plug portion 306 and the interior surface of the flange 308. While the technologies disclosed herein are applicable to many cap and bottle types, preferably, the bottle 400 is a double-walled stainless steel insulating bottle such as a S'well brand bottle made by Can't Live Without It, LLC.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present disclosure is not intended to be limited to the embodiments shown herein but is to be accorded the widest scope consistent with the following claims and the principles and novel features disclosed herein.

The previous description is of one or more preferred embodiments for implementing the disclosed technologies, and the scope of the disclosure should not necessarily be limited by this description. The scope of the present disclosure is instead defined by the following claims.

What is claimed is:

1. A container cap comprising an outer skin assembled and retained on an inner core, wherein:

a. the inner core comprises an inner core bottom edge, a first inner core portion proximate the inner core bottom edge and a second inner core portion proximate the first inner core portion such that the first inner core portion is interposed between the second inner core portion and the inner core bottom edge, the inner core comprising a first exterior diameter T4 at the first inner core portion and a second exterior diameter T3 at the second inner core portion;

b. the outer skin comprises a skirt comprising a rolled bottom edge folded inwardly toward an inner surface of the skirt to form an upwardly extending arm directly adjacent the inner surface of the skirt, wherein the upwardly extending arm comprises a distal edge;

c. the skirt comprises a first interior diameter T2 at the rolled bottom edge and a second interior diameter T1 above the rolled bottom edge;

d. $T4<T3$, $T2<T1$, and $T2<T3$; and e. when the outer skin is assembled on the inner core, the skirt extends at least partially around and in contact with the inner core and the rolled bottom edge of the skirt is proximate the first inner core portion such that the upwardly extending arm of the rolled bottom edge is interposed between the skirt and the inner core and the distal edge of the upwardly extending arm is not exposed on the container cap.

2. The container cap of claim 1, wherein the outer skin is retained on the inner core at least partially via friction fit.

3. The container cap of claim 1, wherein:

a rabbet is defined in the inner core proximate the first inner core portion; and when the outer skin is assembled on the inner core, a least a portion of the upwardly extending arm of the rolled bottom edge is located within a space defined by the rabbet.

4. The container cap of claim 1, wherein the inner core comprises plastic and the outer skin comprises metal.

5. The container cap of claim 4, wherein the outer skin is painted.

6. The container cap of claim 1, wherein the outer skin comprises a top portion from which the skirt downwardly extends.

7. The container cap of claim 3, wherein the rabbet comprises a cheek and a shoulder and wherein, when the outer skin is assembled on the inner core, the upwardly extending arm of the rolled bottom edge is interposed between the skirt and the cheek of the rabbet.

8. The container cap of claim 7, wherein the distal edge of the upwardly extending arm is located adjacent the shoulder of the rabbet when the outer skin is assembled on the inner core.

9. The container cap of claim 8, wherein the outer skin is retained on the inner core at least partially via abutment between the distal edge of the upwardly extending arm and the shoulder of the rabbet.

10. The container cap of claim 1, wherein the distal edge of the upwardly extending arm is located adjacent a surface of the inner core when the outer skin is assembled on the inner core.

11. The container cap of claim 10, wherein the outer skin is retained on the inner core at least partially via abutment between the distal edge of the upwardly extending arm and the surface of the inner core.

12. The container cap of claim 6, wherein the top portion is dome-shaped.

13. A liquid containment vessel having a neck with an opening and a container cap according to claim 1 received on the neck.

14. The liquid containment vessel of claim 13, wherein the vessel is a bottle.

15. The container cap of claim 1, wherein the skirt comprises a substantially tubular shape.

16. The container cap of claim 6, wherein the top portion and the skirt are integral.

17. The container cap of claim 1, wherein the inner core comprises an inner plug portion concentrically surrounded by an outer flange portion having an interior surface, wherein the interior surface of the outer flange portion is spaced a distance from an exterior surface of the inner plug portion, and wherein the outer flange portion comprises the first inner core portion and the second inner core portion.

18. The container cap of claim 17, wherein the outer flange portion further comprises threads on the interior surface of the outer flange portion.

19. The container cap of claim 1, wherein an interior surface of at least one of the first inner core portion and the second inner core portion comprises threads.

20. A container cap comprising an outer skin assembled and retained on an inner core, wherein:

a. the inner core comprises an inner core bottom edge, a first inner core portion proximate the inner core bottom edge and a second inner core portion proximate the first inner core portion such that the first inner core portion is interposed between the second inner core portion and the inner core bottom edge, the inner core comprising a first exterior diameter T4 at the first inner core portion and a second exterior diameter T3 at the second inner core portion, wherein $T4<T3$;

b. a rabbet comprising a shoulder and a cheek is defined in the inner core proximate the first inner core portion;

c. the outer skin comprises a top portion and a skirt extending downwardly from the top portion, wherein the skirt comprises a rolled bottom edge folded inwardly toward an inner surface of the skirt to form an upwardly extending arm directly adjacent the inner surface of the skirt, wherein the upwardly extending arm comprises a distal edge;

d. when the outer skin is assembled on the inner core, the skirt extends at least partially around and in contact with the inner core and the rolled bottom edge of the skirt is proximate the first inner core portion such that the upwardly extending arm of the rolled bottom edge is located within a space defined by the rabbet and is interposed between the skirt and the cheek of the rabbet and such that the distal edge of the upwardly extending arm is located adjacent the shoulder of the rabbet and is not exposed on the container cap.

21. The container cap of claim 20, wherein the outer skin is retained on the inner core at least partially via abutment between the distal edge of the upwardly extending arm and the shoulder of the rabbet.

22. The container cap of claim 20, wherein the outer skin is retained on the inner core at least partially via friction fit.

* * * * *